US007250191B2

(12) United States Patent
Scheubner

(10) Patent No.: US 7,250,191 B2
(45) Date of Patent: Jul. 31, 2007

(54) SELF-ADHESIVE LABELS, THEIR PRODUCTION AND USE

(75) Inventor: Thomas Scheubner, Bad Saeckingen (DE)

(73) Assignee: tesa Aktiengesellschaft, Hamburg (DE)

( * ) Notice: Subject to any disclaimer, the term of this patent is extended or adjusted under 35 U.S.C. 154(b) by 0 days.

(21) Appl. No.: 10/227,027

(22) Filed: Aug. 23, 2002

(65) Prior Publication Data

US 2003/0148055 A1 Aug. 7, 2003

(30) Foreign Application Priority Data

Dec. 21, 2001 (DE) ..... 101 63 589

(51) Int. Cl.
*G09F 3/10* (2006.01)
*G09F 3/02* (2006.01)

(52) U.S. Cl. ..... 427/207.1; 428/40.1; 428/41.8; 428/42.1; 428/343; 428/354; 428/915; 428/916

(58) Field of Classification Search ..... 428/40.1, 428/41.8, 42.1, 343, 354, 915, 916; 427/207.1
See application file for complete search history.

(56) References Cited

U.S. PATENT DOCUMENTS

| | | | | |
|---|---|---|---|---|
| 3,301,728 A | | 1/1967 | Swartz | |
| 4,557,505 A | | 12/1985 | Schaefer et al. | |
| 5,626,966 A | | 5/1997 | Külper et al. | 428/423.1 |
| 5,661,099 A | * | 8/1997 | Mitchell, Jr. | 503/201 |
| 5,985,075 A | * | 11/1999 | Freedman | 156/229 |
| 6,432,528 B1 | * | 8/2002 | Faust et al. | 428/354 |
| 2003/0031861 A1 | * | 2/2003 | Reiter et al. | 428/343 |

FOREIGN PATENT DOCUMENTS

| | | |
|---|---|---|
| DE | 26 13 131 A1 | 10/1977 |
| DE | 81 30 861.2 | 11/1982 |
| DE | 42 31 800 A1 | 3/1994 |
| DE | 43 13 008 C1 | 11/1994 |
| DE | 94 21 868 U1 | 2/1997 |
| EP | 404 402 A | 12/1990 |
| EP | 0 453 131 A2 | 4/1991 |
| EP | 0 578 151 A1 | 1/1994 |
| EP | 0 727 316 A1 | 8/1996 |
| FR | 2 734 655 A1 | 11/1996 |
| JP | 7-164760 | 6/1995 |
| JP | 8-54825 | 2/1996 |
| JP | 8-328474 | 12/1996 |
| WO | WO 88/01288 | 2/1988 |

OTHER PUBLICATIONS

Jianxin Shao, et al. CN1088239; Jun. 22, 1994 "Magnetic Colour-Changing Ink and its preparation and Application";—Abstract.

European Search Report for priority document DE 101 635 89—Aug. 26, 2005.

* cited by examiner

*Primary Examiner*—Daniel Zirker
(74) *Attorney, Agent, or Firm*—Norris McLaughlin & Marcus PA

(57) ABSTRACT

A label comprising at least one first print substrate layer printed on one side with a self-adhesive composition which if desired is lined with a release paper or a release film, where on the first print substrate layer first, on the side directed toward the adhesive a printing ink has been printed, so that there is a printing ink between print substrate layer and adhesive, and secondly, on the side opposite the adhesive surface, a further printing ink has been printed, so that there is a further printing ink on the top face of the print substrate layer.

1 Claim, 15 Drawing Sheets

Flexographic printing with chamber doctor blade

1 = Engraved roller
2 = Plate cylinder
3 = Impression cylinder
4 = Chamber doctor blade

SELF-ADHESIVE LABELS, THEIR PRODUCTION AND USE

The invention relates to self-adhesive labels, to processes for producing them, and to their use.

Labels are generally composed of two or more layers: for example, a print substrate, to which a self-adhesive coating has been applied, and a backing material.

The backing material is generally provided with a release layer of silicone. The function of the backing material is to carry the actual label during production and to protect its adhesive layer against contamination, so that it can pass through processing operations such as printing, punching, cutting, perforating, etc. When the self-adhesive labels are kiss-cut, the siliconized material serves as a punching underlay. Available backing materials include release papers with a variety of release films.

One common backing material for self-adhesive labels are glazed kraft papers. Coated papers are used as well. For specific requirements, such as insensitivity to moisture, for example, polymer-coated paper is additionally used. Furthermore, specialty products such as carbonless copying papers are available as backings.

Polymer films are selected as backing material primarily when the subsequent application imposes particular requirements. Where, for example, a self-adhesive label is to imitate the appearance of a directly printed container (no-label look), container+label manufacturers often recommend siliconized films, which are highly transparent and extremely smooth.

The base material used for silicone paper can be pulp, bleached either conventionally or without chlorine. Release papers are available in a variety of colors. They are employed at different basis weights and thicknesses. The pallet extends from very thin papers through materials in cardboard thickness. In selecting the backing material, the main factor to take account of is the release behavior. Other important features for release protective papers include tear strength, resistance during punching, tensile strength, dimensional stability, and so on. These features must be tailored to the requirements imposed by processing operations and by the manual or automatic dispensing of the labels. The release behavior can be influenced by the type of silicone coating and can therefore be adjusted for different end uses. This plays a large part in particular in the context of the further processing of the self-adhesive labels using automatic dispensers. Rapid, undisrupted dispensing makes the self-adhesive label economically superior.

One special form among self-adhesive labels is represented by what are known as backless (linerless) systems, which operate without siliconized release papers or films. With this form of label it is considered a particular advantage that there is no waste backing material following application. As a result of the absence of a backing, however, the selection among labels is restricted to rectangular forms, since die cutting without backings is not a possibility. The self-adhesive label is not cut off until within the labeling device.

Self-adhesive labels are employed in a very wide variety of applications where they meet an extremely broad spectrum of very different requirements. This is made possible by the selection in the label industry of a diversity of materials unmatched by virtually any other segment. Consequently, their processing requires production means which are similarly diverse in their possibilities. This explains why for label manufacture in particular every available technique is used. An essential part in this context is played by the printing of the self-adhesive labels. The overview below of the various printing technologies, with a description of the basic principle underlying each, facilitates comprehension of the possibilities which lie in the common printing processes such as letterpress, flexographic printing, offset printing, screen printing or gravure printing, and also in the non-impact printing techniques and digital processes.

Relief printing is a term used to encompass the processes of letterpress and flexographic printing.

Letterpress can be regarded as the classic process of reproduction in printing. As long ago as the middle ages it was used primarily for the production of books.

All conventional printing processes require a printing form, also called print carrier, which consists of printing and nonprinting parts. In letterpress, the printing form is often called a plate. Nowadays, photopolymer letterpress printing plates have all but replaced the plates of yesteryear produced by electrotyping or etching. Since the raised parts of the printing plate represent the printing areas, letterpress is one of the relief printing processes. Inking of the printing parts is done by means of a fountain which is composed of a series of rolls. These rolls produce a thin ink film and therefore ink the raised parts of the printing plate. Under a certain applied pressure, the ink is transferred directly from the printing form to the print material. See FIG. 9.

Another of the relief printing processes is flexographic printing. One of the differences from letterpress lies in the printing form, which is substantially more elastic. Consequently, the pressure that need be applied to transfer the design directly from the printing form to the print material is less. This is one important reason for the broad range of materials which can be printed flexographically.

Another difference between the processes lies in the inks, which in letterpress have a very viscous consistency, while flexographic inks are much more mobile. The construction of the inking units is simple accordingly. Inking of the flexographic plates is done by way of engraved rollers. These rollers possess surface indentations which transport a defined quantity of ink. They are filled either by way of a duct roller, which rotates in an ink trough, or by way of an ink chamber which is placed against the engraved roller. See FIGS. 10 and 11.

One specialty in flexographic printing is that of printing with radiation-curing inks. Whereas solvent- or water-based printing inks dry physically, in UV flexographic printing the inks or varnishes are polymerized by the action of UV radiation. The curing reaction passes off in fractions of a second. This reduces the incidence of phenomena typically associated with the flexographic printing process, which come about as a result of the elastic printing form, such as dark fringes or high dark gain.

At the same time, it also makes it easier to print difficult materials such as plastics, metallized films, etc.

Subsumed under planographic printing are the processes of offset printing (wet offset) and waterless offset printing.

Offset printing is one of the planographic printing processes. Printing and nonprinting areas are at virtually the same level. Offset is an indirect printing process. From the printing form, the ink is set off first to a rubber blanket and from there to the print material. Hence the name of this process (setting off=offset). The separation of the printing and nonprinting areas is based on the principle that fat and water repel each other. The printing areas of a metallic offset printing plate are prepared in such a way as to be hydrophobic (water repellent) and so they accept the fatty printing ink. The remaining areas remain hydrophilic (water-loving).

For printing, both water and ink are supplied to the offset plate. The inking is done using an inking unit very similar to that of a letterpress machine. Wetting of the plate surface with water is carried out by means of a damping unit. Given a correct setting of the ink-water balance, separation between printing and nonprinting areas is sharp. This permits a printed image with dot precision and is particularly important in the case of halftone expanses or very fine features. See FIG. 12.

In the case of waterless offset printing, the plates are not damped. In order to prevent inking of the nonprinting sections on the offset plate, they are covered with an ink-repelling silicone coat which during the development of the plates is removed at those places which are later to take ink. As a result, in waterless offset printing the printing areas sit slightly lower. In practice, it is possible by this means to achieve a very high ink density and at the same time to print a very sharp and well-defined dot.

One process which is not often used for printing self-adhesive labels is that of gravure printing. Gravure printing has been developed from old techniques of reproduction such as etching or copperplate engraving. In gravure printing as well, similarly to these artistic processes, the printing sites are engraved or etched into a printing form cylinder. For the inking of the cylinder it runs in an ink trough from which it draws the very low-viscosity gravure printing ink. Excess ink is wiped off with a ground steel strip, known as the doctor blade. Gravure printing is known for its high-quality image reproduction and consistent printing quality. Typical fields of use are therefore the areas of catalog printing and magazine printing, and also the production of packaging. In the context of label manufacture, this process is suitable particularly for long print runs. See FIG. 13.

Subsumed under screen printing are the processes of flatbed screen printing and rotary screen printing.

Screen printing owes its name to the principle of the process, which consists in pressing ink through a fine-meshed screen onto the material to be printed. The "printing form" used is a screen woven from threads of metal, textile or plastic. In order to produce a printed image, the meshes of the fabric are blocked with a copyable coating. After corresponding exposure to light, this layer is washed out at the unexposed areas. In the printing operation, the ink is pressed through these opened meshes onto the print material with the aid of a squeegee. A major advantage of screen printing is the high layer thickness in which the ink can be applied. This opens up the way to the utilization of a wide range of specialty inks or specialty varnishes in screen printing. See FIG. 14.

In label printing, screen printing is employed in two different variants of the process. The differences arise from the construction of the printing form. In flatbed screen printing it is formed by a frame across which a fabric is stretched. For printing, the label web is run beneath the flat screen, stopped, and printed. The web is then transported on by one printed image, so that the next printing operation can take place.

For rotary screen printing a stainless steel fabric is used which is shaped to form a hollow cylinder. The ink supply and the squeegee are arranged inside this cylinder. Because of the rotary construction, this process allows a continuous printing operation. See FIG. 15.

Technical labels are employed in numerous sectors for high-grade applications—for instance, as model identification plates, machines, electrical and electronic appliances, as control labels for process sequences, and as badges of guarantee and testing. In numerous instances these applications automatically entail a need for a greater or lesser degree of security against counterfeiting. This counterfeiting security applies primarily for the period of application and for the entire duration of use on the part to be labeled. Removal or manipulation, if possible at all, should entail destruction or visible, irreversible alteration. In particularly sensitive fields of application there must be a security stage for the production of the labels as well. If it were too easy to acquire and mark such labels, and if imitations were produced, unauthorized persons would be handed the possibility of improperly trafficking in the articles concerned.

For the rational and variable production of high-grade labels, especially in technoindustrial applications, the laser marking of suitable base material is becoming increasingly more established. DE U 81 30 861 describes a multilayer label in which a top layer differing in color is removed with a laser beam and, as a result, the contrasting color with the adjacent layer permits inscriptions of high quality and legibility. Such an inscription constitutes a type of gravure, but removes the possibilities for manipulation associated with traditional printing with inks. DE U 81 30 861 entails the label film being rendered so brittle, by means of the raw materials employed and the production process, that it is impossible to remove the bonded labels from their substrates without destroying them.

An additional security stage is described in the single-layer laser label of DE U 94 21 868: here, in addition to the advantageous properties of DE U 81 30 861, the inscription is brought about not by gravure in the top layer but by a change in color in the polymer layer itself, thereby very substantially preventing subsequent manipulation at the level of the inscriptions.

Consequently, the only potential missing link in the security chain is that such single-layer and multilayer labels are freely available for laser inscription. For goods of appropriately high value, therefore, the acquisition of the labels and their inscription, even with expensive laser equipment, might be regarded as possible and rewarding.

In order to remedy this situation, ongoing development is attempting to design the label stock in such a way, for their subsequent inscription, that such material can be identified at any time, with little effort and no destruction, as being authentic, original material. For the laser labels already mentioned, subsequent identification, although possible in principle, is nevertheless bound up with unacceptable analytical effort and is destructive.

Diverse techniques of ensuring counterfeiting security are known for particularly security-relevant products, such as bank notes, checks, check cards, and personal ID cards, among others. In addition to water marks, printing with intricate patterns, and application of holograms, "invisible" markings are occasionally also employed.

JP 08/328474 A1 describes a textile clothing label which is printed on its top face with a transparent, fluorescent ink, the intention being for the woven design and printed image to be approximately identical in overlap. A similar surface printing with UV-active, photochromic inks is described in WO 88/01288 A1; in order to protect the chemicals, however, this ink layer requires an additional layer for protection against oxygen and water.

In FR 2,734,655 A1, a security marking on checks is achieved by virtue of the fact that, in part, the printing under a layer which is permeable only to IR is invisible in the visible wavelength range but can be read/identified by machine using special IR light.

EP 0 727 316 A1 achieves hidden counterfeiting security by providing, in an extra layer, especially on paper, two reactive components which give a color reaction under pressure—this reaction, however, is irreversible.

The use of electroconductive and magnetic inks for surface printing is described in JP 08/054825 A1 and CN 1,088,239 A1, respectively. For label applications on complex metal parts, such as vehicle and machine components, for example, the fitness of such systems for use is extremely limited.

The ink ribbons with fluorescent particles that are described in JP 07/164760 A1 and can be excited by IR are transferred by means of heat, using thermal transfer printers. Although it is true that the prints constitute a hidden sign of originality, the printing is applied superficially and can be altered or removed with solvents, with heat or else mechanically.

DE 42 31 800 A1 describes labels which for security against counterfeiting leave irremovable traces on the substrates by means of sublimation inks or corrosive substances—in order to identify the traces, however, it is first necessary to remove the label, which is in many cases undesirable if not impossible.

For high-security papers such as passports, shares, banknotes, etc., EP 0 453 131 A1 describes the incorporation into an interlayer between two permanently bonded plies of paper, along with the laminating adhesive, of fluorescent—especially UV-fluorescent—indicators, which are detectable only on transmission of light at appropriate wavelength through the laminate, but not by reflection under incident light. This system is unsuited to applications where transmission of light through the bonded label is impossible, and for the totally opaque laser labels.

All of these methods are applied superficially or are effective superficially and are therefore useful only to an extremely limited extent, if at all, for the known laser labels, since in this case the surface of high optical quality and extreme resistance used, for example, for model identification plate applications would be altered and impaired. Such a modification would be particularly disruptive to the two-layer labels with a high-gloss black top layer and white base layer, which may be regarded as the technical standard for identification plates. In addition, the means of security against counterfeiting which are known from the prior art, and which are applied superficially, subsequently, carry with them the potential for manipulation to be carried out mechanically or using heat, chemicals, etc.

The customary printing processes in label printing have already been depicted in detail above.

Normally, labels are produced by printing directly on the print material (paper or film, 60 μm PP or 100 μm PE, for example) (frontal printing).

Labels of this kind can also be laminated with a laminating film (12 μm PP, for example) in order to protect the printing. This is described by way of example in DE 197 47 000 A1. In particular therein a way is found which makes it possible to incorporate, variably and cost-effectively, a customer-specific security mark at the stage of the label stock. Especially when using the standard label film of DE U 81 30 861 or DE U 94 21 868, printing is carried out on the reverse of the film prior to coating with adhesive.

Use is made here in particular of specialty printing inks containing fluorescent substances, daylight-fluorescent inks, or, in particular, color pigments which can be excited by means of IR or UV radiation. After printing, the material obtained is processed in the standard way by coating with self-adhesive composition, drying, and lining with release paper.

Also known are transfer-printed labels, where a base film (for example, a 60 μm PP film) is printed with a mirror-image version of the desired image and then, in further operations, the printed film is coated with adhesive, the backing is laminated on, and the labels are die-cut. With these labels, the printing is on the side facing the adhesive. For reasons which are easy to comprehend, this process is very complicated and hence is associated with high production costs.

Then again, there are labels represented on the market which have what has been called interlayer printing. A laminating film with a thickness, for example, of 30 μm is printed with a mirror-image version of the required image, is laminated in an appropriate laminating station together with a correspondingly thin (for example, 30 μm PP) self-adhesive material, and then the assembly is die-cut. Labels of this kind are generally produced in one operation. This process does make it possible to obtain an excellent silver print (in general, intaglio print). With these labels, however, all of the printing is on the inside face of the laminating film (interlayer printing). The printing is not plastic and shows no relief effect, which for certain applications is required. Accordingly, only the laminating film is printed from the inside face, without additional printing on the top face of the label.

One object of the present invention is to create a self-adhesive label where the print substrate or one layer of print substrate has printing on both sides; in other words, in particular, transfer-printed elements (in interlayer printing or transfer printing) are combined with elements produced by frontal printing.

Another object of the invention is to provide processes for producing self-adhesive labels of this kind.

The first object is achieved by labels as specified herein. Other advantageous developments of the subject matter of the invention are also described herein. The invention further provides proposed uses of the label of the invention, and also outstandingly designed processes for producing the label.

The invention accordingly provides a label comprising at least one first print substrate layer printed on one side with a self-adhesive composition which if desired is lined with a release paper or a release film, where on the first print substrate layer on the side directed toward the adhesive a printing ink has been printed, so that there is a printing ink between print substrate layer and adhesive, and on the side opposite the adhesive surface, a further printing ink has been printed, so that there is a further printing ink on the top face of the print substrate layer.

In one preferred embodiment of the invention (interlayer printing) there is a second print substrate layer below the adhesive, the underside of said layer being coated with a self-adhesive composition which if desired is lined with a release paper or release film. In this case the second print substrate layer is the actual print substrate of the base label and the first print substrate layer is the laminating film. Moreover, the top adhesive coating constitutes the laminating adhesive of the label.

It is preferable if lamination takes place following the printing of the underside of the print substrate or of the first print substrate layer (transfer-printed elements).

It is also preferable if the printing ink is applied by frontal printing to the top face of the print substrate or of the first print substrate layer after lamination has taken place.

It is also preferable if in the case of transfer-printed elements the printing inks are metallic in color (silver printing, gold printing, etc.).

In one outstandingly designed embodiment of the label of the invention, in addition to the printing of metallic inks in the form of transfer-printed elements, there is at the same points on the top face a raised print (frontal printing), especially a print with a transparent relief varnish (from Sicpa, for example, 78-3-021) or with a conventional transparent screen printing ink.

In this way it is possible to simulate the relief character of a hot-stamped foil, producing an effect very similar to that of hot foil stamping.

As materials for the print substrate or the first print substrate layer it is possible in accordance with the invention to use films, especially monoaxially and biaxially oriented films based on polyolefins, i.e., films based on oriented polyethylene or oriented copolymers containing ethylene and/or polypropylene units, and also, possibly, PVC films, PET films, films based on vinyl polymers, polyamides, polyesters, polyacetals, and polycarbonates.

In particular, films based on oriented polyolefin or oriented copolymers containing ethylene and/or polypropylene units can be used as print substrates in accordance with the invention.

Monoaxially oriented polypropylene is distinguished by its very high tensile strength and low elongation in the machine direction. For producing the labels of the invention, monoaxially oriented films based on polypropylene are preferred. The thicknesses of the monoaxially oriented, polypropylene-based films are situated preferably between 20 and 100 μm, in particular between 25 and 65 μm, very particularly between 30 and 60 μm. Monoaxially oriented films are predominantly single-layer films, although multilayer monoaxially oriented films can also be produced in principle. Known films include predominantly one-, two-, and three-layer films, although the number of layers chosen may also be greater.

The thicknesses of the biaxially oriented, polypropylene-based films are situated in particular between 12 and 100 μm, especially between 20 and 75 μm, very particularly between 30 and 60 μm.

Biaxially oriented films based on polypropylene can be produced by means of blown film extrusion or by means of customary flat film units. Biaxially oriented films are produced in both single-layer and multilayer forms. In the case of multilayer films, the thickness and composition of the various layers may also be the same, although different thicknesses and compositions are also known.

Particular preference for the labels of the invention is given to single-layer, biaxially or monoaxially oriented films and multilayer biaxial or monoaxial films based on polypropylene which possess a sufficiently firm bond between the layers, since delamination of the layers in the course of the application is a disadvantage.

Films based on unplasticized PVC are used for producing labels, as well as films based on plasticized PVC.

For the labels of the invention it is preferred to use films based on unplasticized PVC (PVCu). The thicknesses of the films are situated preferably between 20 and 100 μm, in particular between 25 and 65 μm, very particularly between 30 and 60 μm.

Polyester-based films, based on polyethylene terephthalate, for example, are likewise known and can also be used for producing the labels of the invention. The thicknesses of the PET-based films are situated between 20 and 100 μm, in particular between 25 and 65 μm, very particularly between 30 and 60 μm.

Polyesters are polymers whose building blocks (monomer units) are held together by ester bonds (—CO—O—). According to their chemical structure, the homopolyesters can be divided into two groups:

the hydroxy carboxylic acid types (AB polyesters) and the dihydroxy dicarboxylic acid types (AA-BB polyesters).

The former are prepared from only one single monomer by means, for example, of polycondensation of an ω-hydroxy carboxylic acid 1 or by ring-opening polymerization of cyclic esters (lactones) 2, for example

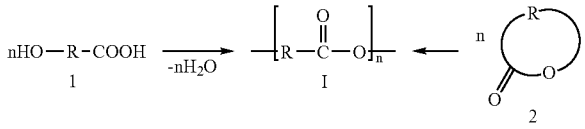

The latter, in contrast, are synthesized by polycondensation of two complementary monomers, such as a diol 3 and a dicarboxylic acid 4:

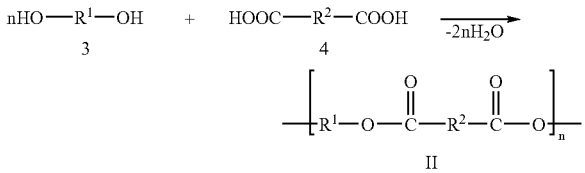

Branched and crosslinked polyesters are obtained in the polycondensation of trihydric or higher polyhydric alcohols with polyfunctional carboxylic acids. The polyesters are generally considered to include the polycarbonates (polyesters of carbonic acid).

AB-type polyesters (I) include polyglycolic acids (polyglycolides, R=CH2), polylactic acids (polylactides, R=CH—CH3), polyhydroxybutyric acid [poly(3-hydroxybutyric acid), R=CH(CH3)-CH2], poly(ε-caprolactone)s [R=(CH2)5], and polyhydroxybenzoic acids (R=C6H4).

Purely aliphatic AA-BB-type polyesters (II) are polycondensates of aliphatic diols and dicarboxylic acids, used among other things as products with terminal hydroxyl groups (as polydiols) for preparing polyesterpolyurethanes (for example, polytetramethylene adipate; R1=R2=(CH2)4].

Most important industrially in terms of quantity are AA-BB-type polyesters of aliphatic diols and aromatic dicarboxylic acids, especially the polyalkylene terephthalates [R2=C6H4, with polyethylene terephthalate (PET) R1=(CH2)2, polybutylene terephthalate (PBT) R1=(CH2)4 and poly(1,4-cyclohexanedimethylene terephthalate)s (PCDT) R1=CH2—C6H10—CH2] as the most important representatives. By using other aromatic dicarboxylic acids as well (isophthalic acid, for example) and/or by using diol mixtures for the polycondensation it is possible to vary the properties of these types of polyester broadly and to adapt them to different fields of application.

Purely aromatic polyesters are the polyarylates, which include poly(4-hydroxybenzoic acid) (formula I, R=C6H4), polycondensates of bisphenol A and phthalic acids (formula II, R1=C6H4—C(CH3)2-C6H4, R2=C6H4) or else of those bisphenols and phosgene.

As materials for the second print substrate layer in the case of the embodiment described (interlayer printing) it is also possible without exception to use any self-adhesive materials which are commonly employed for producing self-adhesive labels. Such labels comprise, as is known, a print substrate coated with a self-adhesive composition which is lined with a liner, generally a release paper or release film.

Reference may be made at this point to the range of self-adhesive materials offered, for example, by the company Avery (Fasson).

For this embodiment, use is made in particular of self-adhesive materials with a thin print substrate, so that the overall thickness of the label laminated with the first print substrate layer corresponds to that of conventional labels.

Preference is given to self-adhesive materials with a print substrate based on PP having a thickness of from 25 to 60 μm, with particular preference to those having a thickness of from 30 to 40 μm.

Likewise possible for use without restriction are every kind of self-adhesive compositions which are supplied for self-adhesive materials. Depending on the intended application, permanent, detachable, and deep-freeze adhesives, self-adhesive compositions for no-label look labels, etc. are employed.

Printing inks used for the printing processes described are commercially customary inks from the respective suppliers of label printing inks. By way of example, for label materials comprising polyolefin films, UV-curing offset/flexographic/letterpress/screen printing inks and solventborne gravure printing inks are offered: for example, the Flexocure series for UV flexographic printing, from Akzo.

In order to take account of anticounterfeit aspects in the labels employed, a variety of different pigments and dyes can be employed in the printing inks.

The most widespread are long-afterglow (phosphorescent) or fluorescent pigments, which are excited solely or predominantly by UV radiation and which emit in the visible region of the spectrum (for an overview see, for example, Ullmanns Enzyklopädie der technischen Chemie, 4th edition, 1979, Verlag Chemie).

Also known, however, are IR-active luminescent pigments. Examples of systems with UV fluorescence are xanthenes, coumarins, naphthalimides, etc., which in some cases are referred to in the literature under the generic term 'organic luminophores' or 'optical brighteners'. The addition of a few percent of the luminescent substances concerned is sufficient, incorporation into a solid polymer matrix being particularly favorable in respect of luminosity and stability.

Examples of formulations which can be employed are those with RADGLO® pigments from Radiant Color N.V., Netherlands, or Lumiluxe® CD pigments from Riedel-deHaën. Inorganic luminescent substances are also suitable. As long-afterglow substances, especially with the emission of light in the yellow region, metal sulfides and metal oxides have been found favorable, generally in conjunction with appropriate activators. These compounds are obtainable, for example, under the trade name Lumilux® N or, as luminescent pigments improved in terms of stability, luminosity and afterglow persistence, under the trade name LumiNova® from Nemoto, Japan.

Also suitable in principle are luminescent substances excited by electron beams, X-rays, and the like, and also thermochromic pigments, which undergo a reversible color change when the temperature changes. The use of electrically conductive inks is a further possibility.

When selecting the color pigments it should be borne in mind that they must be sufficiently stable for the further production process of the labels (for example, adhesive coating) and should not undergo irreversible change under the process conditions (possibly thermal drying, electron beam curing or UV curing, and the like).

Such security marking is protected against external access, since the print lies embedded, for example, between the label film and the adhesive layer. There is no risk of subsequent manipulation, since it is impossible to detach the labels without destroying them.

Customer-specific "finger printing" of the labels can be brought about by a printed application of different colors or patterns. Regular patterns of lines and strokes in particular allow characteristic patterns of points of luminescence to be produced at the edges of the label and are, moreover, particularly sparing in terms of material and finances. Following the die cutting or laser cutting of the label and its application to the substrate, a pattern which is characteristic in terms of colors and geometries can be perceived at the edge of the label when an appropriate source of illumination is chosen.

The advantage of this security marking is manifested in particular in terms of logistics and costs. Commercial printing inks and non-specific label film material can be employed and yet the said material can otherwise be produced in a customer-specific manner. Since such standard stock material, however, is used by label manufacturers only as an intermediate even for their own manufacture and is not freely available on the market, however, there is no possibility of unauthorized access. In addition, small batch sizes and short delivery times are possible.

As the ink in one possible embodiment a UV screen printing ink can be selected which is prepared in accordance with the following formula:

10% by weight UV-Tronic HM luminescent paste 806.025
90% by weight Bargoscreen UV series 78-2 "transparent"
(both in components from SICPA Druckfarben GmbH)

The two components are mixed thoroughly and admixed with 2% by weight of UV-Tronic Fotoinitiator 806.330.

In order to produce an assembly in the case of labels with interlayer printing, a variety of adhesive systems can be used. Examples of suitable laminating adhesives are UV flexographic printing laminating adhesives, hotmelt laminating adhesives, pressure sensitive adhesives, two-part adhesives or the like.

UV laminating adhesives have proven advantageous. For example, using the laminating adhesive UV 9402 from Akzo, a bonded assembly of this kind can be produced between the transfer-printed first print substrate web and the second print substrate web, the self-adhesive material.

Hotmelt laminating adhesives are particularly advantageous for the labels of the invention. An example is the hotmelt laminating adhesive A2700 from Novamelt, which is applied using a slot die, especially one having a rotating rod.

Hotmelt pressure sensitive adhesives are likewise outstandingly suitable for laminating in the case of interlayer printing, and also for the self-adhesive coating in the case of transfer printing.

As the laminating adhesive or pressure sensitive adhesive, the labels of the invention may comprise a self-adhesive composition based on natural rubber, PU, acrylates or styrene-isoprene-styrene block copolymers.

The use of adhesives based on natural rubber, acrylates or styrene-isoprene-styrene is known, and is also described, for example, in the "Handbook of pressure sensitive adhesive technology", second edition, edited by Donatas Satas, Van Nostrand Reinhold, N.Y., 1989.

As the self-adhesive composition use is made in particular of a commercially customary pressure sensitive adhesive based on PU, acrylate or rubber.

Customary and suitable for the inventive transfer printing application are UV-curing pressure sensitive adhesives, which are applied by flexographic techniques.

An adhesive which has been found particularly advantageous is one based on acrylic hotmelt, having a K value of at least 20, in particular more than 30, which is obtainable by concentrating a solution of such an adhesive to give a system which can be processed as a hotmelt.

The concentration process may take place in appropriately equipped vessels or extruders; especially when devolatilization accompanies this process, a devolatilizing extruder is preferred.

An adhesive of this kind is specified in DE 43 13 008 A1, whose content is hereby incorporated by reference to become part of this disclosure and invention. In an intermediate step, the solvent is removed completely from the acrylic compositions prepared in this way.

In addition, further highly volatile constituents are removed. Following coating from the melt, these compositions contain only low levels of volatile constituents. Accordingly, it is possible to adopt all of the monomers/formulas claimed in the abovementioned patent. Another advantage of the compositions described in the patent can be seen in their possession of a high K value and thus a high molecular weight. The skilled worker will be aware that systems with higher molecular weights can be crosslinked more efficiently. This is accompanied, therefore, by a reduction in the fraction of volatile constituents.

The solution of the composition may contain from 5 to 80% by weight, in particular from 30 to 70% by weight, solvent.

Preference is given to using commercially customary solvents, especially low-boiling hydrocarbons, ketones, alcohols and/or esters.

It is further preferred to use single-screw, twin-screw or multiscrew extruders having one or, in particular, two or more devolatilizing units.

Benzoin derivatives may have been incorporated by copolymerization into the adhesive based on acrylic hotmelt: for example, benzoin acrylate or benzoin methacrylate, acrylic or methacrylic esters. Benzoin derivatives of this kind are described in EP 0 578 151 A1.

In addition, however, the adhesive based on acrylic hotmelt may also have been chemically crosslinked.

In one particularly preferred embodiment, the self-adhesive compositions used are copolymers of (meth)acrylic acid and esters thereof having from 1 to 25 carbon atoms, maleic, fumaric and/or itaconic acid and/or their esters, substituted (meth)acrylamides, maleic anhydride, and other vinyl compounds, such as vinyl esters, especially vinyl acetate, vinyl alcohols and/or vinyl ethers.

The residual solvent content should be below 1% by weight.

An adhesive which is found particularly suitable is a low molecular mass, pressure sensitive acrylic hotmelt adhesive as carried under the designation acResin UV or Acronal®, especially Acronal DS 3458, by BASF. This low-K adhesive acquires its application-oriented properties as a result of a final, radiation-chemically initiated crosslinking process.

It is also possible to use an adhesive selected from the group of the natural rubbers or from the group of the synthetic rubbers or consisting of any desired blend of natural rubbers and/or synthetic rubbers, the natural rubber or rubbers being selectable in principle from all available grades such as, for example, crepe, RSS, ADS, TSR or CV types, depending on required purity level and viscosity level, and the synthetic rubber or synthetic rubbers being selectable from the group of randomly copolymerized styrene-butadiene rubbers (SBR), butadiene rubbers (BR), synthetic polyisoprenes (IR), butyl rubbers (IIR), halogenated butyl rubbers (XIIR), acrylic rubbers (ACM), ethylene-vinyl acetate (EVA) copolymers, and polyurethanes and/or blends thereof.

Furthermore, in order to improve their processing properties, the rubbers may preferably be admixed with thermoplastic elastomers in a weight fraction of from 10 to 50% by weight, based on the overall elastomer content.

As representatives, mention may be made at this point primarily of the particularly compatible styrene-isoprene-styrene (SIS) and styrene-butadiene-styrene (SBS) grades.

As tackifying resins it is possible without exception to use all of the tackifier resins which are known and are described in the literature. As representatives, mention may be made of rosins, their disproportionated, hydrogenated, polymerized, esterified derivatives and salts, aliphatic and aromatic hydrocarbon resins, terpene resins, and terpene-phenolic resins. Any desired combinations of these and other resins may be used in order to adjust the properties of the resultant adhesive in accordance with what is desired. Explicit reference is made to the depiction of the state of the art in the "Handbook of Pressure Sensitive Adhesive Technology" by Donatas Satas (van Nostrand, 1989).

The term "hydrocarbon resin" is a collective designation for thermoplastic polymers which are colorless to intense brown in color and have a molar mass of generally <2000.

They may be divided according to their provenance into three main groups: petroleum resins, coal tar resins, and terpene resins. The most important coal tar resins are the coumarone-indene resins. The hydrocarbon resins are obtained by polymerizing the unsaturated compounds that can be isolated from the raw materials.

Also included among the hydrocarbon resins are polymers obtainable by polymerizing monomers such as styrene and/or by means of polycondensation (certain formaldehyde resins), with a correspondingly low molar mass. Hydrocarbon resins are products with a softening range that varies within wide limits from <0° C. (hydrocarbon resins liquid at 20° C.) to >200° C. and with a density of from about 0.9 to 1.2 g/cm$^3$.

They are soluble in organic solvents such as ethers, esters, ketones, and chlorinated hydrocarbons, and are insoluble in alcohols and water.

Rosin is a natural resin which is recovered from the crude resin from conifers. Three types of rosin are differentiated: balsam resin, as the distillation residue of turpentine oil; root resin, as the extract from conifer root stocks; and tall resin, the distillation residue of tall oil. The most significant in terms of quantity is balsam resin.

Rosin is a brittle, transparent product with a color ranging from red to brown. It is insoluble in water but soluble in many organic solvents such as (chlorinated) aliphatic and aromatic hydrocarbons, esters, ethers, and ketones, and also in vegetable oils and mineral oils. The softening point of rosin is situated in the range from approximately 70° C. to 80° C.

Rosin is a mixture of about 90% resin acids and 10% neutral substances (fatty acid esters, terpene alcohols, and hydrocarbons). The principal rosin acids are unsaturated carboxylic acids of empirical formula C20H30O2, abietic acid, neoabietic acid, levopimaric acid, pimaric acid, isopimaric acid, and palustric acid, as well as hydrogenated and dehydrogenated abietic acid.

The proportions of these acids vary depending on the provenance of the rosin.

As plasticizers it is possible to use any plasticizing substances known from adhesive technology. These include, among others, the paraffinic and naphthenic oils, (functionalized) oligomers such as oligobutadienes, oligoisoprenes, liquid nitrile rubbers, liquid terpene resins, vegetable and animal oils and fats, phthalates, and functionalized acrylates.

For the purpose of thermally induced chemical crosslinking it is possible to use any known, thermally activatable chemical crosslinkers such as accelerated sulfur systems or sulfur donor systems, isocyanate systems, reactive melamine resins, formaldehyde resins, and (optionally halogenated) phenol-formaldehyde resins and/or reactive phenolic resin or diisocyanate crosslinking systems with the corresponding activators, epoxidized polyester resins and acrylic resins, and also combinations thereof.

The crosslinkers are preferably activated at temperatures above 50° C., in particular at temperatures from 100° C. to 160° C., with very particular preference at temperatures from 110° C. to 140° C.

The thermal excitation of the crosslinkers may also be accomplished by means of IR radiation or high-energy alternating fields.

All conceivable end uses are open to the label of the invention. Particularly advantageous is the use of the label on packaging forms such as tubes, trays, cans or bottles made of glass, plastic or metal, especially in the embodiment with silver printing and relief varnish. Such a label has very pleasing esthetics and is highly attractive to potential customers when placed appropriately on the packaging.

The label of the invention can be produced very advantageously by the following methods in particular.

For interlayer printing, a process is depicted in which labels can be produced with both transfer-printed and frontally printed elements in one operation.

For transfer printing, on the other hand, a label production process is described wherein the application of transfer-printed and frontally printed elements and/or of elements produced by only one of these modes of printing takes place in one operation with the application of a self-adhesive composition and the laminated attachment of the carrier material.

In a first label production process in a single operation the print substrate web is printed on the side directed toward the adhesive (transfer printing) and on the opposite side (frontal printing), and in the same operation a release-coated carrier web is introduced and a self-adhesive composition is applied to one side of one of the two webs, generally to the release layer of the carrier web, so that during subsequent lamination an assembly is produced between print substrate and carrier.

In an alternative mode of production, in the form of the printing of both sides of the print substrate or of the first print substrate web prior to lamination, the invention is not restricted in any way. In this case, first both sides of the web are printed in succession, with the aid of a turn bar, followed by lamination.

In the preferred embodiment, the assembly is turned following lamination with the aid of a turn bar.

A further advantageous process encompasses the following steps:

A reel with a carrier material, such as a release paper, is unrolled from one of the two unwinders.

On another unwinder, a reel with the print substrate web is unrolled.

The print substrate web is printed with any number of the available printing stations.

Printing takes place selectively by offset, letterpress, flexographic or screen printing, in particular by gravure printing.

The carrier material is coated on the release-coated side with a self-adhesive composition.

The carrier material and the print substrate web are laminated to one another so that the self-adhesive composition covers the printing on the print substrate web.

The laminated web is then turned in the machine.

The top face of the print substrate web can then be printed in accordance with the printing units still available.

This takes place selectively by offset, letterpress, flexographic or gravure printing, in particular by screen printing.

If desired, the individual labels are die-cut.

If desired, the label web is rolled up.

On the basis of the figures described below, this process is explained in more detail, in one particularly advantageous version of the equipment required for the process, without wishing thereby to restrict the invention unnecessarily. In the drawings,

| | |
|---|---|
| 11 | Frontal print |
| 1 | Print substrate<br>60 μm PP film |
| 12 | Transfer print |
| 2 | Pressure sensitive adhesive |
| 3 | Silicone film/silicone paper |

Figure 8:
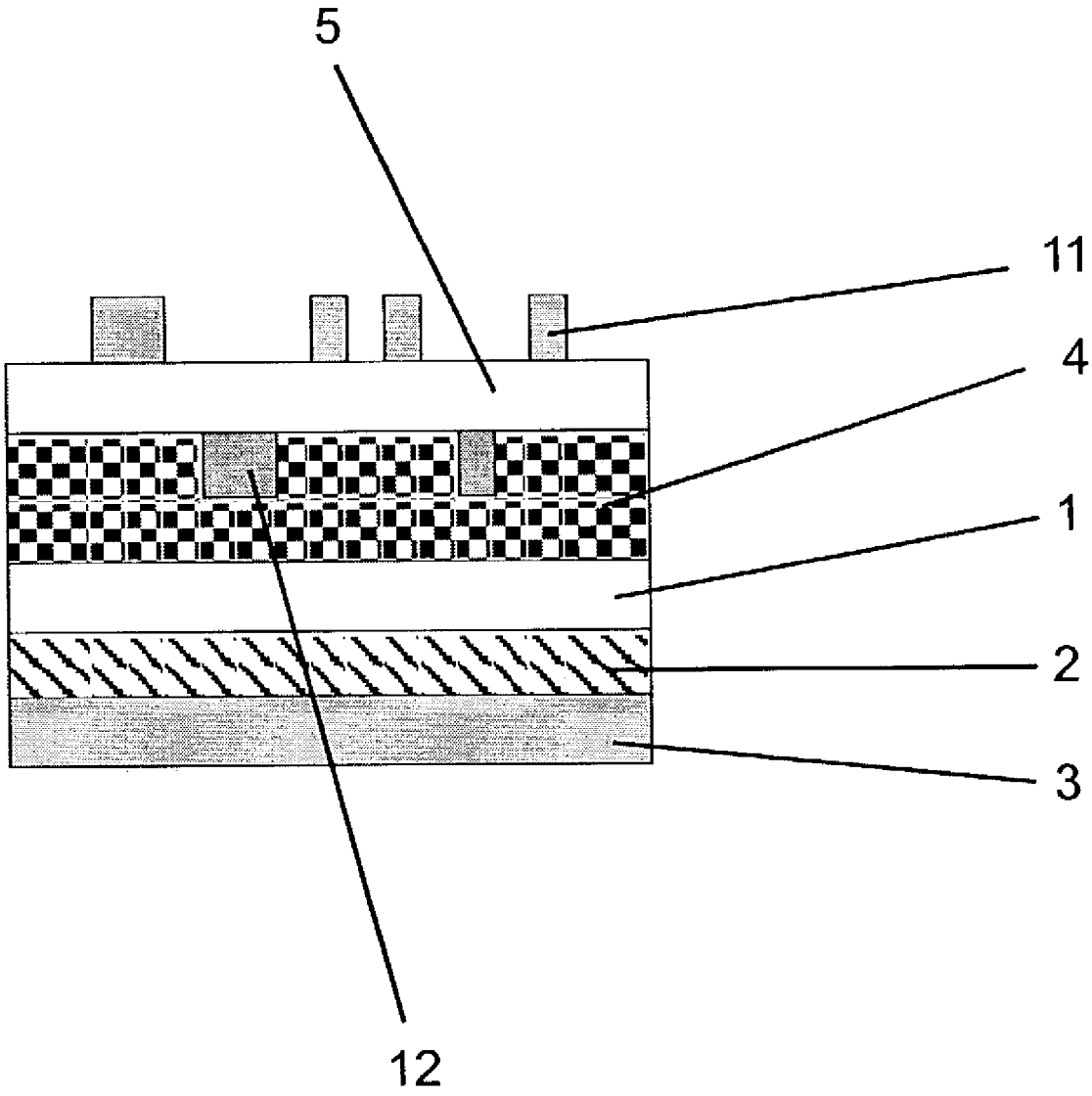

FIG. 8 shows a label of the invention wit the following layers:

| | |
|---|---|
| 11 | Frontal print |
| 5 | 1st print substrate web<br>30 μm PP film |
| 12 | Transfer print |
| 4 | Laminating adhesive |
| 1 | 2nd print substrate web<br>30 μm PP film<br>(base label) |

-continued

| | |
|---|---|
| 2 | Pressure sensitive adhesive |
| 3 | Silicone film/silicone paper |

Figure 9:
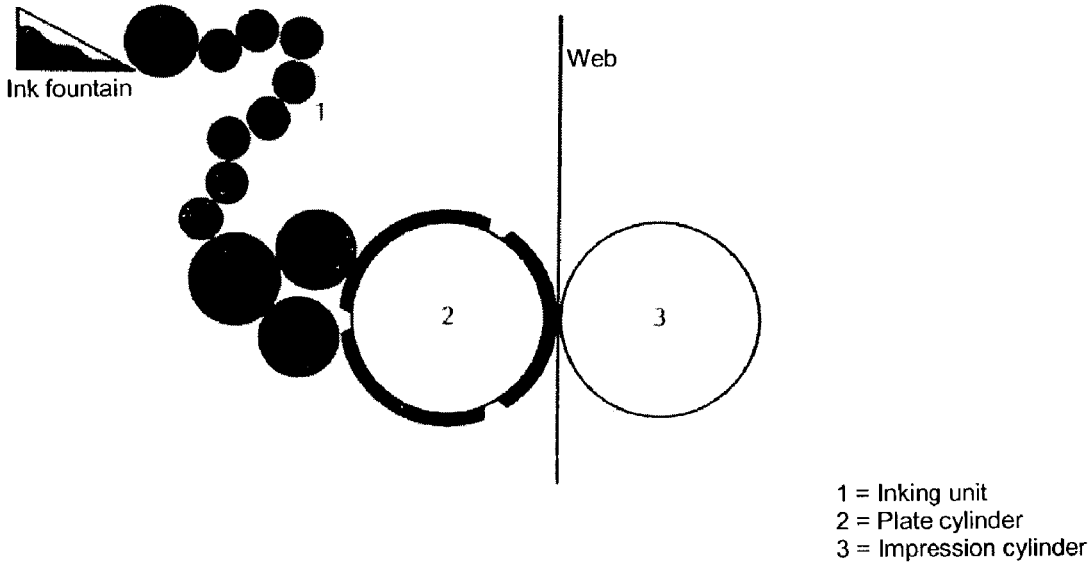

FIG. 9 shows a letterpress process

Figure 10:
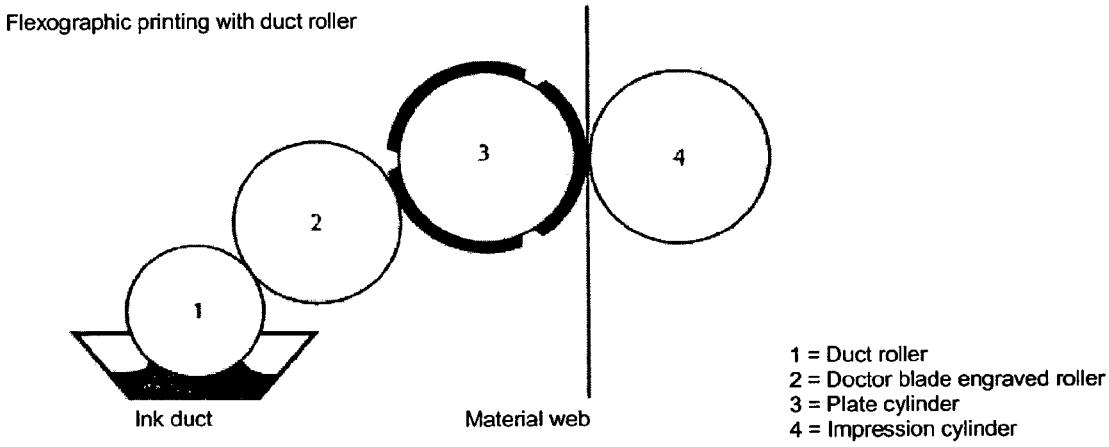

FIG. 10 shows a flexographic printing with duct roller

Figure 11:
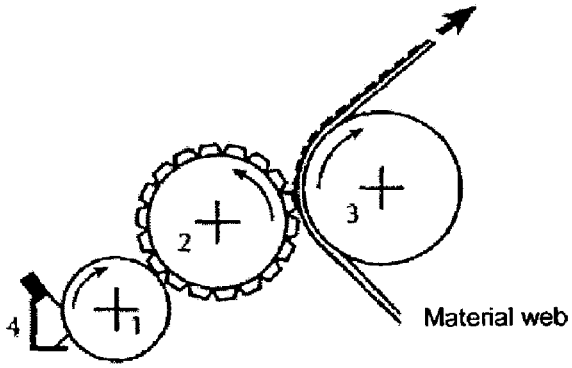

FIG. 11 shows a flexographic printing with chamber doctor blade

Figure 12:
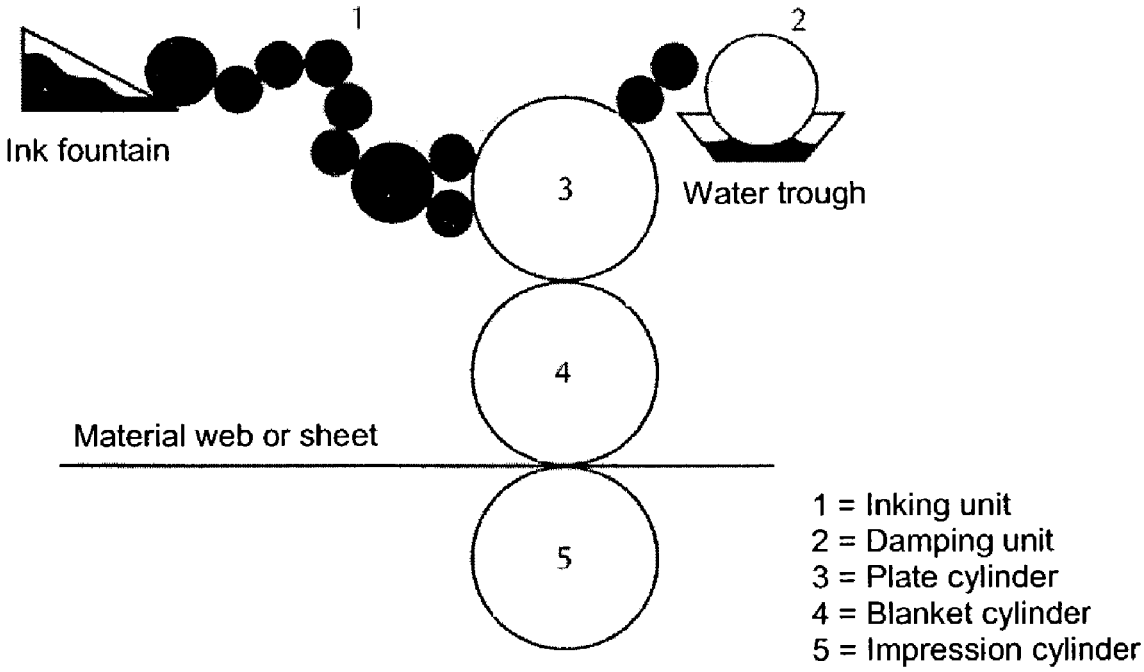

FIG. 12 shows an offset printing process

Figure 13:
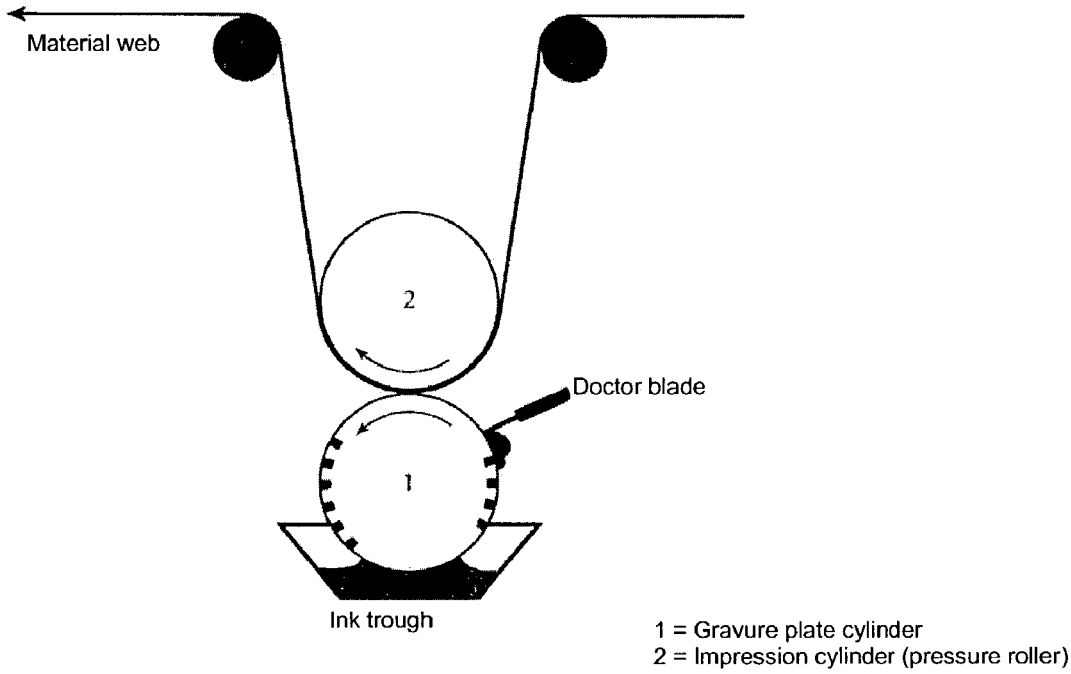

FIG. 13 shows a gravure printing process

Figure 14:
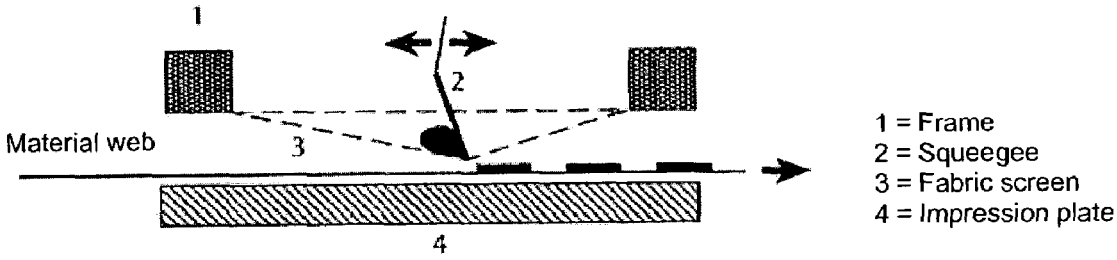

FIG. 14 shows a flatbed printing process

Figure 15:
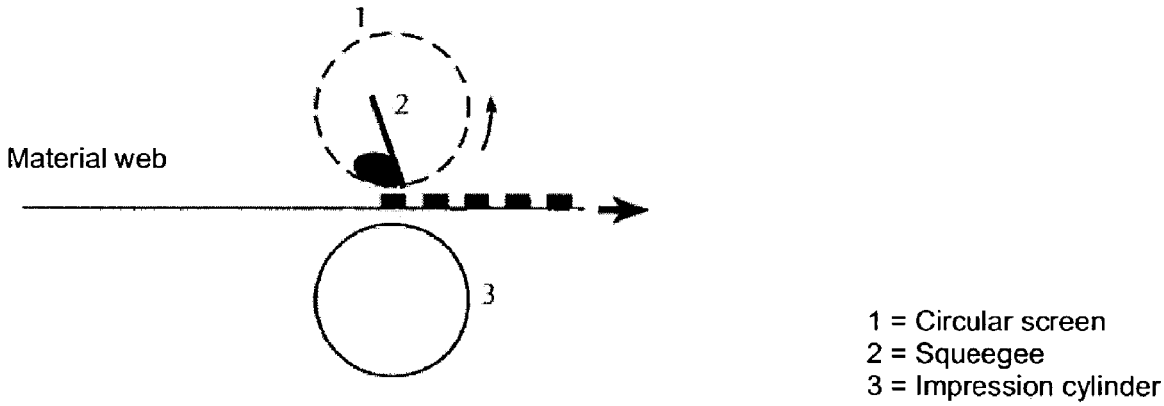

FIG. 15 shows a rotary screen printing process

Figure 1:
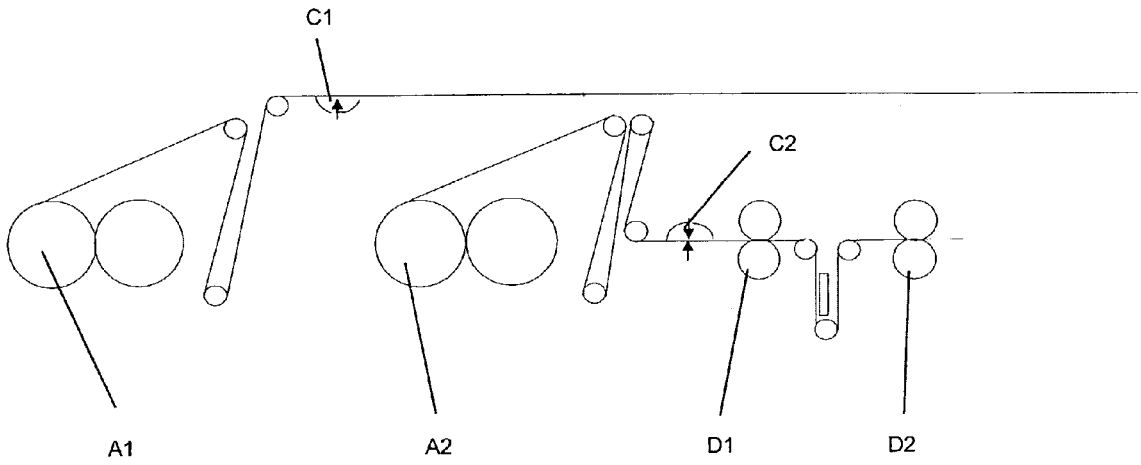
FIG. 1 shows the equipment needed to produce the label, from the unwinder to the printing unit 2.
Figure 2:
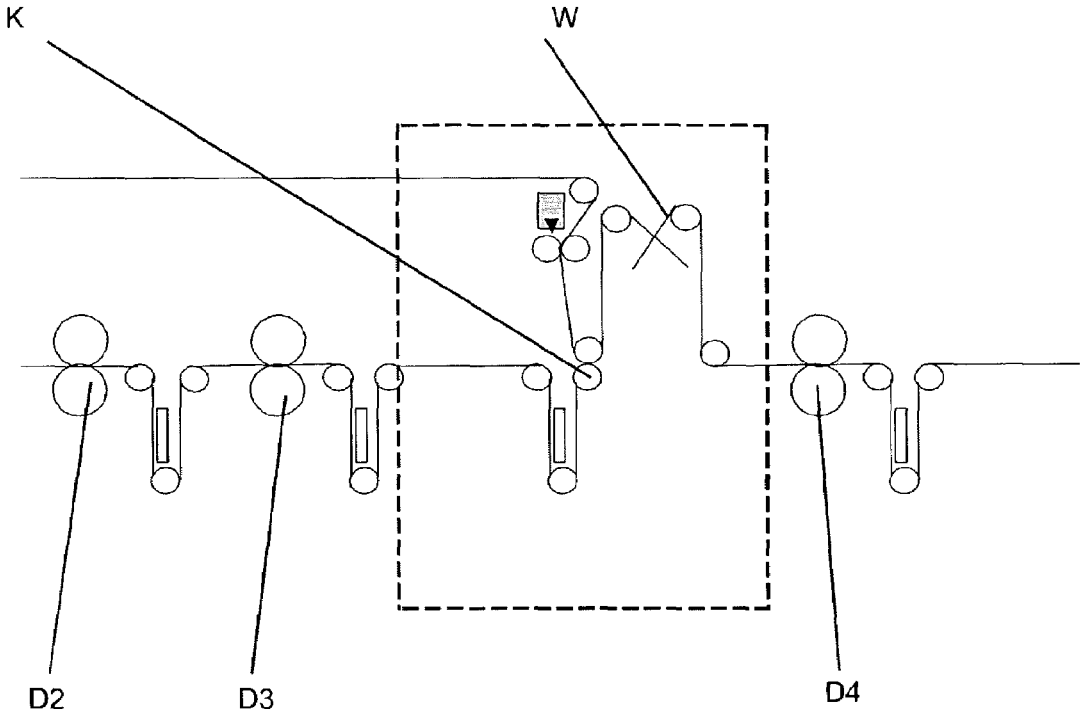
FIG. 2 shows the equipment needed to produce the label, with the printing units 2 to 4, the hotmelt coating unit, the laminating station, and the turnbar W.
Figure 3:
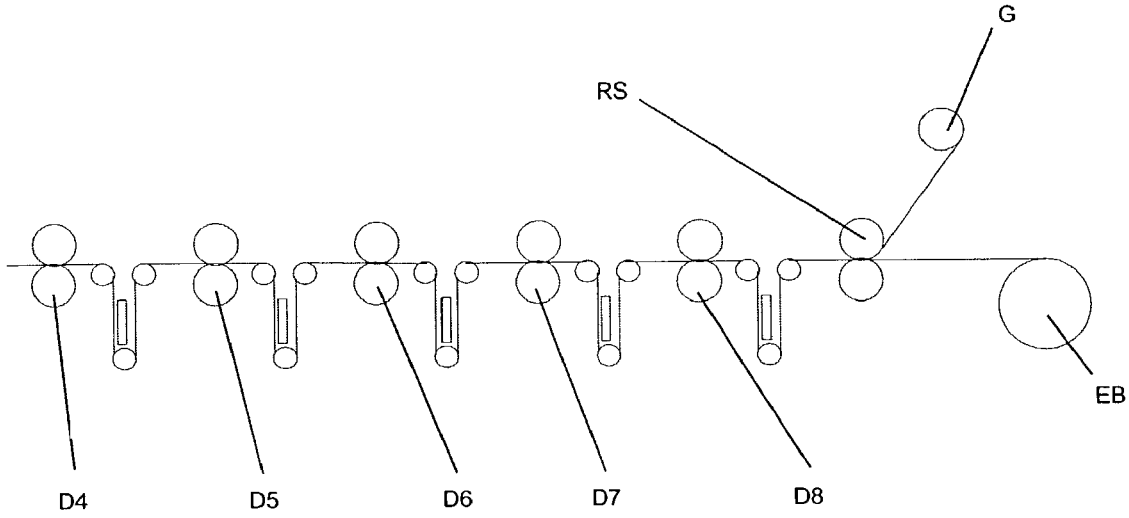
FIG. 3 shows the equipment needed to produce the label, from the printing unit 4 to the winder.

As depicted by way of example in FIGS. 1 to 3, in a label printing machine especially designed for this purpose, a reel with a carrier material is unrolled from one of the two unwinders, in this case the unwinder A1, and a reel with the print substrate web is unrolled from another unwinder, in this case the unwinder A2.

In the station C2, the film surfaces are corona pretreated, generally on both sides.

The print substrate web is provided with the desired imprint in the printing units D1 to D(x), shown here in the printing units D1 to D3. In the laminating station, K, a self-adhesive composition is applied to the release-coated side of the carrier material. The carrier material and the print substrate web are then laminated together in such a way that the self-adhesive composition covers the printing on the first carrier layer.

An alternative mode of manufacture is depicted in FIG. 2, showing the application of a self-adhesive composition in a flexographic process.

Subsequently, the laminated web is turned at the turnbar W so that the top face of the print substrate web can be printed in the printing units D(x+1) to D(z), shown here in the printing units D4 to D8.

In the rotary punch RS, the individual labels are die-cut, followed by matrix stripping, G. After that, the label web EB is rolled up.

An advantageous feature of the process of the invention is that the self-adhesive coating can take place at any desired position in the machine, in other words at any of the printing units D1 to D(z), in the case depicted D1 to D8, with lamination at the printing unit D3. Accordingly, any desired combinations of transfer printing (K) and frontal printing (F) are possible: K=1 to z; F=1 to (z-K).

In this case the pressure sensitive adhesive is coated indirectly, in other words first to the carrier material, preferably a silicone film; this is not intended to constitute any restriction on this invention, since a self-adhesive coating applied to the printed web prior to lamination with the carrier material is likewise feasible.

The second process encompasses the following steps:

A reel of self-adhesive material with the second print substrate web, on which there is self-adhesive composition lined with a carrier material, is unrolled from one of the two unwinders.

On another unwinder, a reel with the first print substrate web is unrolled.

The first print substrate web is printed with any number of the available printing stations.

Printing takes place selectively by offset, letterpress, flexographic or screen printing, in particular by gravure printing.

The second print substrate web and the first print substrate web are laminated together in such a way that the laminating adhesive covers the printing on the first print substrate web.

The laminated web is then turned in the machine.

The top face of the first print substrate web is then printed in accordance with the printing units still available.

This takes place selectively by offset, letterpress, flexographic or gravure printing, in particular by screen printing.

If desired, the individual labels are die-cut.

If desired, the label web is rolled up.

On the basis of the figures described below, this process is explained in more detail, in one particularly advantageous version of the equipment required for the process, without wishing thereby to restrict the invention unnecessarily. In the drawings, FIG. 4 shows the equipment needed to produce the label, from the unwinder to the printing unit 2, FIG. 5 shows the equipment needed to produce the label, with the printing units 2 to 5, the laminating station, and the turnbar, and FIG. 6 shows the equipment needed to produce the label, from the printing unit 4 to the winder.

Figure 4:
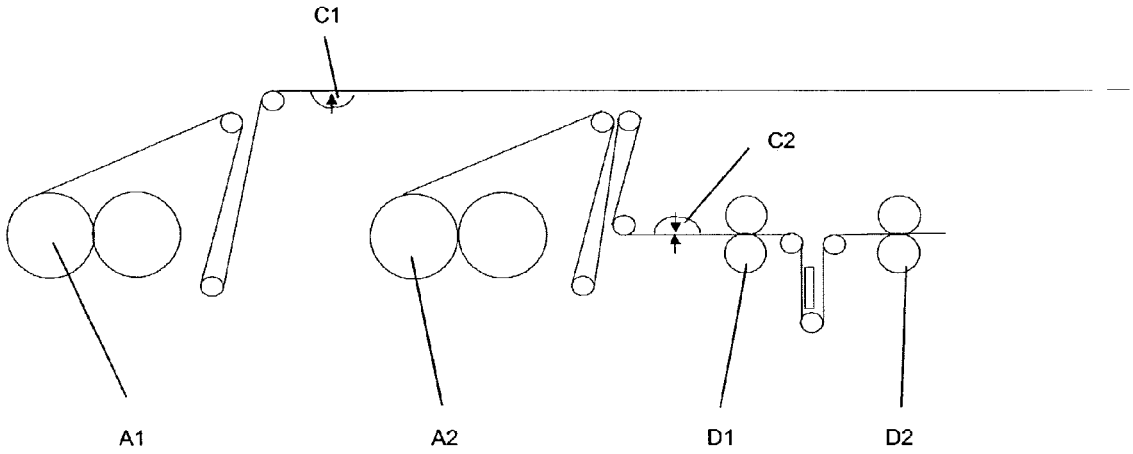
FIG. 4 shows the equipment needed to produce the label, from the unwinder to the printing unit 2.
Figure 5:
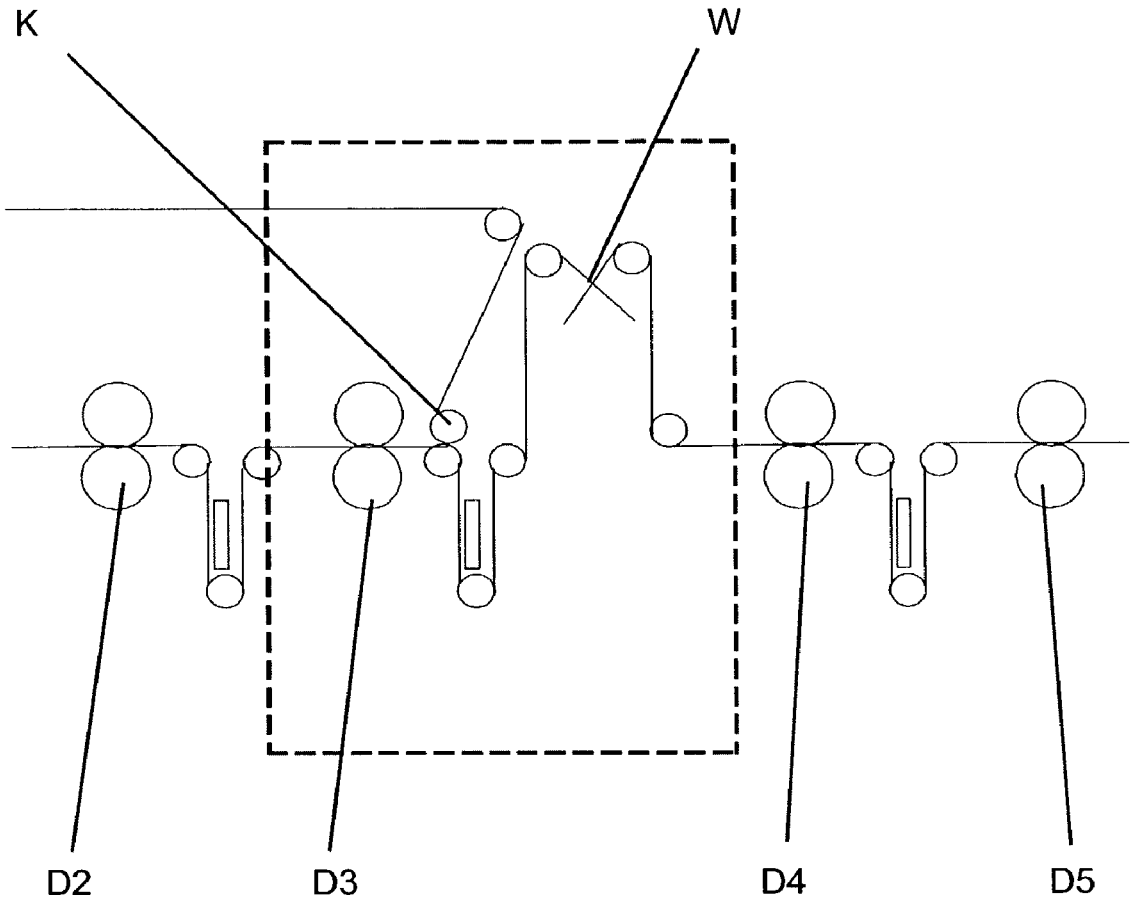
FIG. 5 shows the equipment needed to produce the label, with the printing units 2 to 5, the laminating station, and the turnbar.
Figure 6:
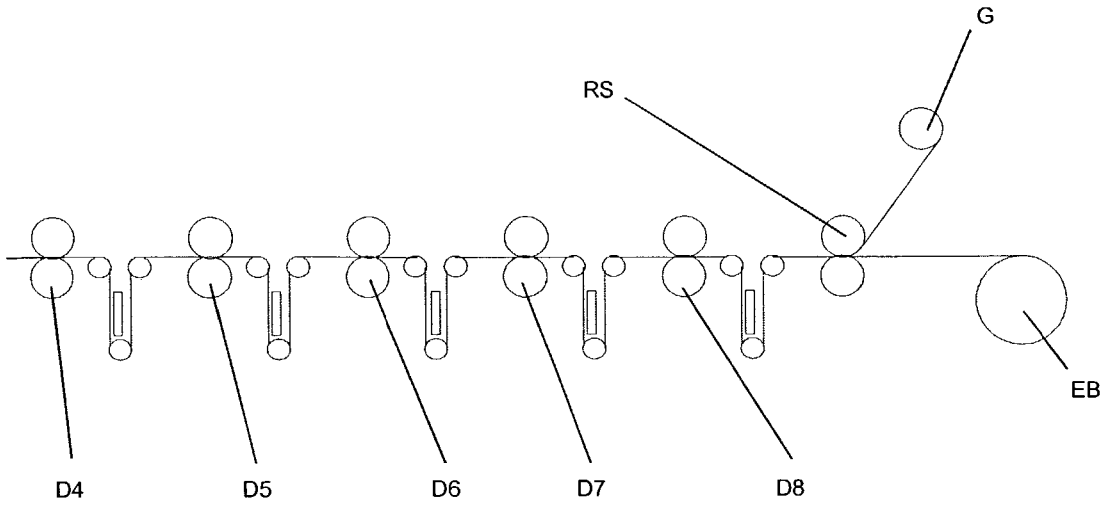
FIG. 6 shows the equipment needed to produce the label, from the printing unit 4 to the winder.

As depicted by way of example in FIGS. 4 to 6, in a label printing machine especially designed for that purpose, a reel with the second print substrate web, a self-adhesive material, consisting of print substrate, self-adhesive composition, and carrier material, is unwound from one of the two unwinders, in this case the unwinder A1. A reel with the first print substrate web is unrolled from another unwinder, in this case the unwinder A2.

In the stations C1 and C2, the surfaces of the materials are corona pretreated on one or both sides.

The first print substrate web is provided with the desired imprint in the printing units D1 to D(x), shown here in the printing units D1 to D3 (interlayer printing).

The second print substrate web and the first print substrate web are laminated together in the laminating station K in such a way that the adhesive covers the print on the first carrier layer.

An alternative, very advantageous mode of manufacture is depicted in FIG. 5, representing the coating of the self-adhesive composition in a hotmelt process.

Subsequently, the laminated web is turned at the turnbar W so that the top face of the first print substrate web can be printed in the printing units D(x+1) to D(z), shown here in the printing units D4 to D8.

In the rotary punch RS, the individual labels are die-cut, followed by matrix stripping, G.

After that, the label web EB is rolled up.

An advantageous feature of the process of the invention is that the lamination can take place at any desired position in the machine, in other words at each of the printing units D1 to D(z), in the case shown D1 to D8, with lamination at the printing unit D3. Accordingly, any desired combinations of transfer printing (K) and frontal printing (F) are possible: K=1 to z; F=1 to (z-K).

The label of the invention features elements which can be produced by the frontal printing process and then further elements which are produced by transfer printing and/or interlayer printing. The label combines the advantages of both printing process variants.

Certain printing inks are situated internally (interlayer printing or transfer printing), in combination with printing units situated on the top (frontal printing).

Both processes have advantages. Interlayer printing is used, for example, to obtain an effective, inexpensive silver print, while in frontal printing a better relief effect is achieved (generally screen printing). Moreover, it is an advantage of transfer printing that the printing inks are protected against media (dispensed products, chemicals, etc.).

The intention of the text below is to illustrate the invention with reference to two examples; here again, there is no intention to restrict the invention unnecessarily.

EXAMPLES

Example 1

Transfer/Frontal Printing

Film biaxially oriented, coextruded film based on polypropylene, from BIMO corona pretreated on both sides

| | |
|---|---|
| film thickness: | 60 μm (STILAN MP/B 60) |
| elongation at break, MD: | 200% (ASTM D 882) |
| elongation at break, TD: | 70% (ASTM D 882) |
| modulus of elasticity, MD: | 2000 N/mm$^2$ (ASTM D 882) |
| modulus of elasticity, TD: | 3400 N/mm$^2$ (ASTM D 882) |

Silicone Film (Release Film)

commercial silicone film from Siliconatura

| | |
|---|---|
| film thickness: (or silicone paper) | 30 μm PET (Silphan S 30 M74F) |

Printing Inks

UV-curing offset/flexographic/letterpress/screen printing ink or solventborne gravure printing ink, as offered, for example, by Akzo, in the form of the Flexocure series for UV flexographic printing, for example Adhesive Acrylic hotmelt PSA for producing a self-adhesive material; for example, Acronal DS 3458, from BASF The adhesive is applied over the full area by means of a slot die (for example, Nordson BC 40, rotating rod principle) and is UV-crosslinked.

(Alternatively, flexographic UV PSAs or dispersion-/solvent-based PSAs can be used.

Figure 7:
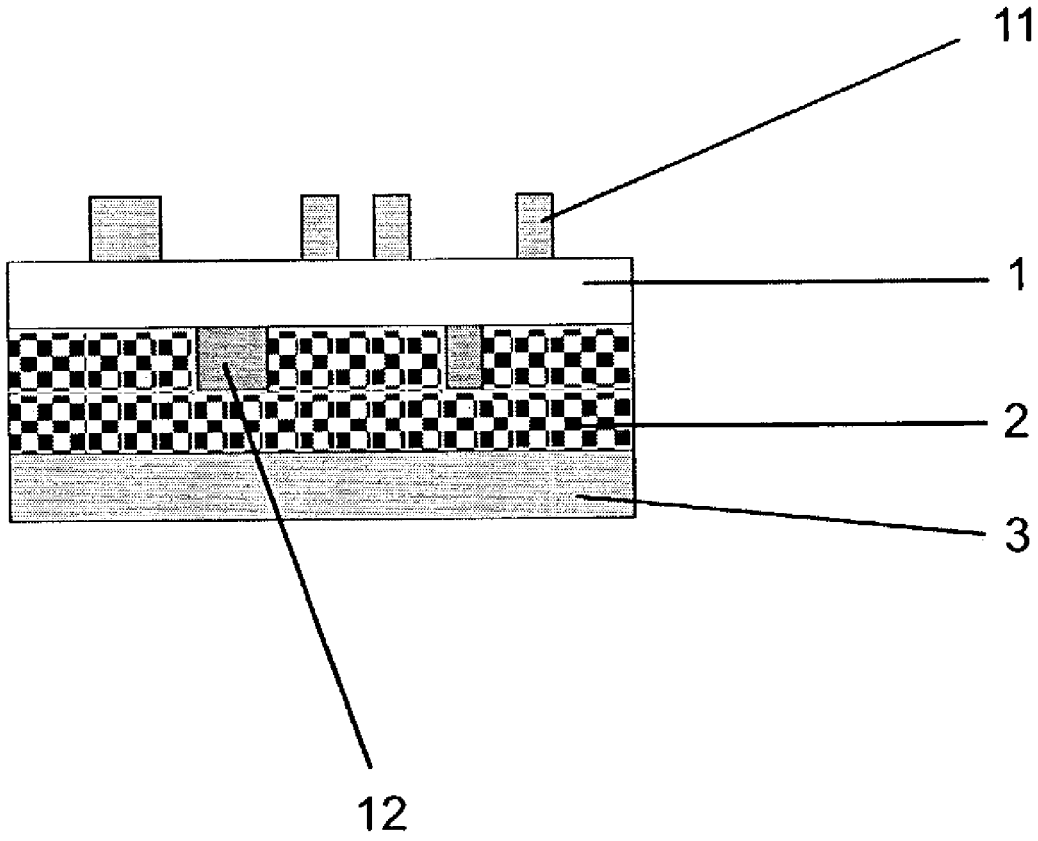
FIG. 7 shows a label of the invention with the following layers.

FIG. 7 shows a label of the invention with the following layers:

| | |
|---|---|
| 11 | Frontal print |
| 1 | Print substrate<br>60 μm PP film |
| 12 | Transfer print |
| 2 | Pressure sensitive adhesive |
| 3 | Silicone film/silicone paper |

Example 2

Interlayer/Frontal Printing

Laminating Film biaxially oriented, coextruded film based on polypropylene, from BIMO corona pretreated on both sides

| | |
|---|---|
| film thickness: | 30 μm (STILAN BS/B 60) |
| elongation at break, MD: | 200% (ASTM D 882) |
| elongation at break, TD: | 70% (ASTM D 882) |
| modulus of elasticity, MD: | 2000 N/mm$^2$ (ASTM D 882) |
| modulus of elasticity, TD: | 3400 N/mm$^2$ (ASTM D 882) |

Self-Adhesive Material commercial label material, from Raflatac

| | |
|---|---|
| top film: | 30 μm polypropylene |
| pressure sensitive adhesive: | any desired PSA used for label material, based for example on acrylate (Raflatac, RP 37) |
| silicone film (or silicone paper) | polyester 36 μm |

Printing Inks

UV-curing offset/flexographic/letterpress/screen printing ink or solventborne gravure printing ink, as offered, for example, by Akzo, in the form of the Flexocure series for UV flexographic printing, for example.

Laminating Adhesive laminating adhesive suitable for laminating the film to the self-adhesive material; for example, UV flexographic printing laminating adhesive (Akzo, UV 9402), hotmelt laminating adhesive, PSAs, hotmelt PSA, two-part adhesive or the like.

FIG. 8 shows a label of the invention with the following layers:

| | |
|---|---|
| 11 | Frontal print |
| 5 | 1st print substrate web<br>30 μm PP film |
| 12 | Transfer print |
| 4 | Laminating adhesive |
| 1 | 2nd print substrate web<br>30 μm PP film<br>(base label) |
| 2 | Pressure sensitive adhesive |
| 3 | Silicone film/silicone paper |

What is claimed is:

1. A process for producing a label, the process comprising the steps of:

unrolling a first reel with a carrier material from a first of two unwinders, unrolling a second reel with a print substrate web from a second of the two unwinders, printing on the print substrate web by a first printing method selected from the group consisting of offset, letterpress, flexographic and screen printing, coating a release-coated side of the carrier material with a self-adhesive layer, laminating the carrier web and the print substrate web to one another so that the self-adhesive layer covers the printing on the print substrate web, turning the laminated web, printing on a top face of the print substrate web by a second printing method different from said first printing method, wherein said second printing method is selected from the group consisting of offset, letterpress, flexographic and gravure printing, optionally, die-cutting the laminated web to form individual labels, and optionally, rolling up the label which is in the form of the laminated web, wherein said resultant label comprises at least one print substrate layer having a first and opposing second side with a self-adhesive layer coated on the first side, the self-adhesive layer optionally being lined with a release paper or a release film on its outer surface, wherein the first print substrate layer has a first printing ink printed on the first side of the print substrate layer so that the first printing ink is between the print substrate layer and the self-adhesive layer, and a second printing ink printed on the second side, so that the second printing ink forms a top face of the opposing print substrate layer second side.

* * * * *